United States Patent [19]

Fisher

[11] Patent Number: 4,483,625

[45] Date of Patent: Nov. 20, 1984

[54] CONTINUOUS SOLID PARTICULATE MIXER CONVEYOR HAVING VARIABLE CAPACITY

[75] Inventor: Glen W. Fisher, Bellevue, Wash.

[73] Assignee: Technovators, Inc., Seattle, Wash.

[21] Appl. No.: 485,023

[22] Filed: Apr. 14, 1983

Related U.S. Application Data

[63] Continuation of Ser. No. 232,950, Feb. 10, 1981, abandoned, which is a continuation of Ser. No. 961,635, Nov. 17, 1978, abandoned.

[51] Int. Cl.[3] ..... B01F 7/04

[52] U.S. Cl. ..... 366/297; 366/196; 366/327

[58] Field of Search ..... 366/297, 300, 322, 324, 366/326, 327, 14, 83, 84, 91, 145, 168, 271, 293, 254, 319, 88, 323, 603, 195, 196; 426/507, 460

[56] References Cited

U.S. PATENT DOCUMENTS

| | | | |
|---|---|---|---|
| 1,204,700 | 11/1916 | Schofield | 366/327 X |
| 1,498,286 | 6/1924 | Marsh | 366/300 X |
| 1,570,086 | 1/1926 | Schaffer | 366/168 X |
| 2,080,327 | 5/1937 | McKinnis | 366/300 X |
| 2,205,814 | 6/1940 | Forster, Jr. | 366/145 X |
| 2,766,021 | 10/1956 | Edgington | 366/327 X |
| 3,385,528 | 5/1968 | Schaus | 426/507 X |
| 3,807,702 | 4/1974 | Grillo et al. | 366/327 |
| 4,128,052 | 12/1978 | Mueller et al. | 366/168 X |
| 4,205,094 | 5/1980 | Baird et al. | 426/507 X |
| 4,281,934 | 8/1981 | Krause et al. | 366/300 |

*Primary Examiner*—Billy J. Wilhite
*Assistant Examiner*—Christine A. Peterson
*Attorney, Agent, or Firm*—Dowrey & Cross

[57] ABSTRACT

A method and apparatus for increasing the capacity of paddle screw mixer conveyors based on creating a dam of mixed particulate material and another substance at the outlet end of the mixer. A second embodiment uses two counter rotating shafts of paddles to increase mixing efficiency. Methods of grain treatment utilizing the mixer are illustrated.

13 Claims, 9 Drawing Figures

11
12
13
14
16
17
21
22
23
28
29

FIG. 3
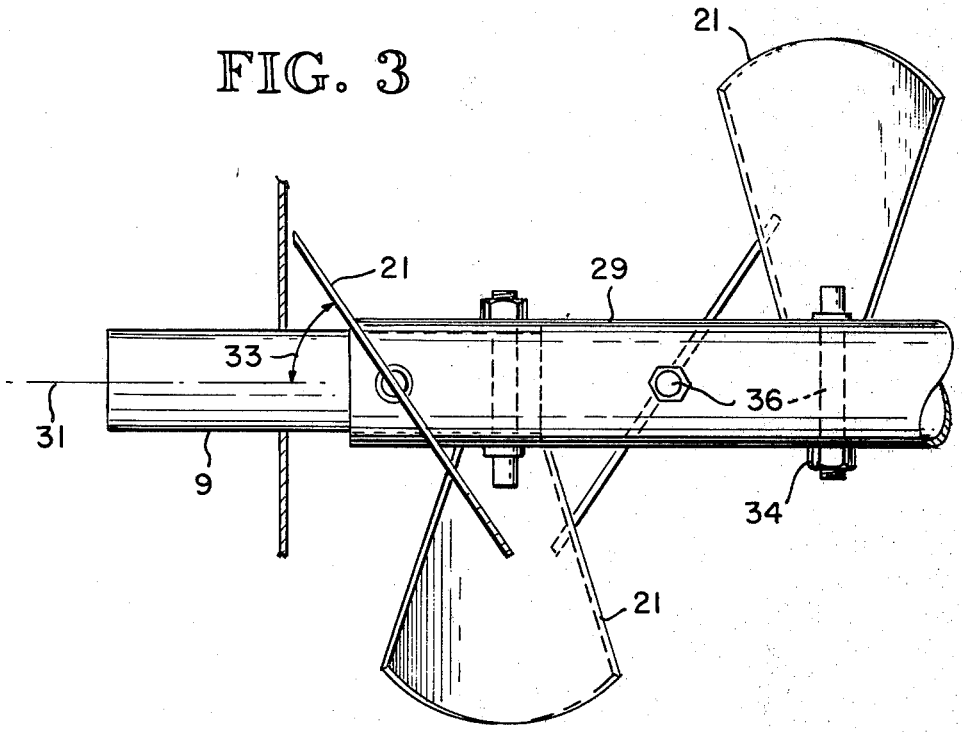
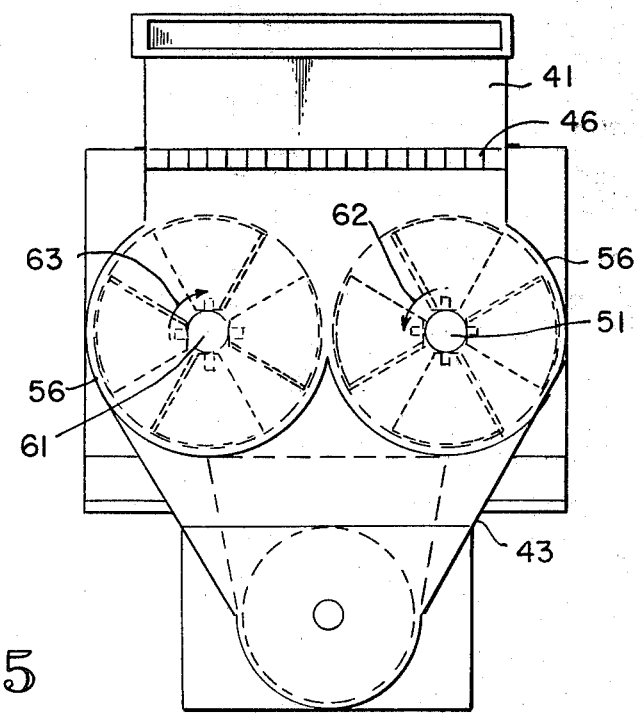
FIG. 5

FIG.7
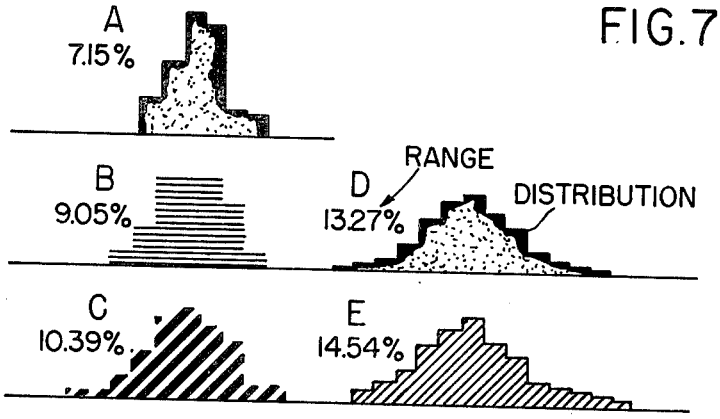
3
FIG.8
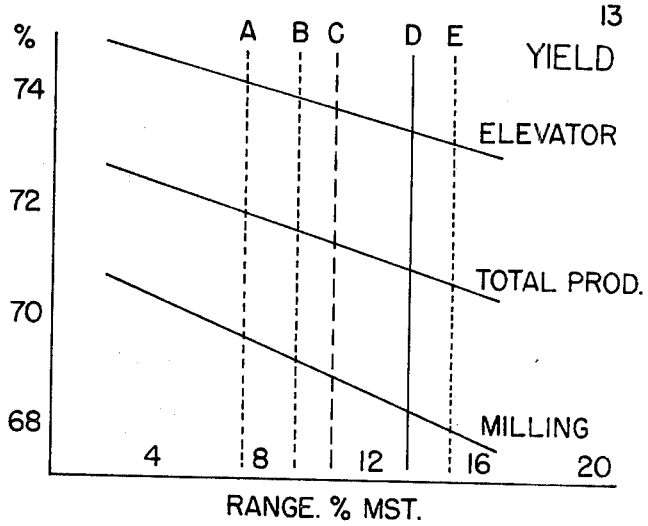
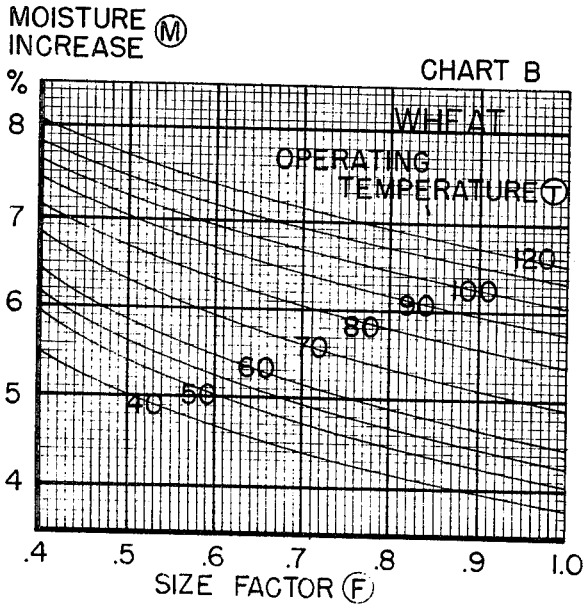
FIG.9

CONTINUOUS SOLID PARTICULATE MIXER CONVEYOR HAVING VARIABLE CAPACITY

This application is a continuation of application Ser. No. 232,950 filed Feb. 10, 1981, which is a continuation of application Ser. No. 961,635, filed Nov. 17, 1978, both abandoned.

BACKGROUND OF THE INVENTION

This invention relates to a system for treating solid particulate material. More particularly, the system of this invention proves for the ultimate mixing of an adherable substance with solid particulate material on a continuous basis. This invention is particularly suited to cereal grain tempering processes involving the admixture of controlled amounts of water to the grain while a grain is being conveyed from one storage bin to another.

In traditional milling operations grain was washed clean before milling and the cleaning water discarded. This was typically accomplished by grain washing apparatus that immersed the grain in water and then spun the grain to centrifuge the water off. Any material adhering to the hull of the grain was carried away by the water. Inherently, the immersion step resulted in water adhering to the grain surface and absorbed into the grain, thus raising the grain mositure level. The wet processes are now all but abandoned due to the difficulties in processing the resultant streams of polluted water formed as a by-product.

Millers have now converted to dry scouring processes to comply with water pollution regulations. Dry scourers remove adherent impurities but do not wet the grain. Consequently, subsequent processing of the grain must involve water addition since milling processes are most productive when operating on tempered grain.

Because grain has been typically conveyed from one storage to another with screw conveyors, millers combined material and water in a screw conveyor to provide for water addition. Such systems required the use of long screw conveyors to enable the water added in the wetting screw to penetrate the grain, otherwise the added water would run off and puddle when the grain was subsequently stored. This system allowed a maximum addition of about 3% of water to wheat, for example.

The applicant herein recognized that such screw conveyor systems did not mix the grain to ensure even wetting.

Therefore, the applicant developed a paddle mixer-conveyor system that provided a far superior alternative to wetting screw conveyor systems. The paddle mixer-conveyor utilized paddles oriented to lift the grain upward such that some kernels advance and some fall back to be mixed again. This paddle mixer-conveyor uniquely created such enormous particle-to-particle surface contact that free moisture (i.e. unpenetrated moisture) distribution among the particles was accomplished with a then-hitherto-unknown efficiency and with a much shorter conveyor length. In the case of water addition to wheat, for example, superior moisture addition could be obtained within about 18 to 20 seconds in amounts up to the adhesion water/wheat limit of about 4.5% water without subsequent water runoff.

SUMMARY OF THE INVENTION

The system of this invention provides an improved paddle mixer-conveyor apparatus. Functionally, applicant's improved paddle mixer-conveyor enables water addition above the water/grain adhesion limit and enables a greater volumetric throughput.

Applicant has also discovered that his improved paddle mixer-conveyor can accomplish these results while at the same time effecting a reduction in the particle-to-particle variance in moisture content. Thus, a grain body of greater homogeneity in terms of individual particle moisture content is unexpectedly produced in applicant's improved paddle mixer-conveyor. This discovery has resulted in the creation of new processes and techniques for water addition to grain.

The mixter-conveyor system of the present invention comprises means for conveying solid particulate material from an inlet, where an adherent material (to be mixed with the particulate material) is added, to an outlet where the mixed adherent material and the particulate material are discharged. The conveying mechanism of the system is arranged such that the particulate material is conveyed upwardly at an acute angle from the horizontal against a resistance that effects a substantially uniform bed depth of particulate material being conveyed. The resistance in the preferred apparatus of the invention, applicant's improved paddle mixer-conveyor, is achieved by appropriate selection of the pitch angle of the paddles such that the natural tendency of a body of particulate material to assume its normal angle of repose is overcome and such that the conveyor capacity is increased. By appropriate paddle pitch angle settings, an optimum conveyor bed depth or capacity, (i.e. volume of material contained in the mixer-conveyor at a given time) can be attained while unexpectedly providing the miller with the choice of either increasing the throughput (i.e. volume of material processed per unit time) through the mixer-conveyor or increasing the retention time (i.e. average time that a particle is resident and subject to processing in the mixer-conveyor from the inlet to the outlet) of particular material.

For a given retention time the capacity and throughput are directly related. An increase in capacity can be used to either increase throughput or retention time. An algorithm has been devised for setting the individual paddles in a paddle mixer-conveyor to maximize the capacity and control the retention time. The increased capacity is provided by establishing a dynamic dam of admixed particulate material within the mixer-conveyor. This dam prevents the particulate material from seeking its natural angle of repose and allows the mixer to contain a greater amount of admixed particulate material. The greater capacity afforded may then be utilized either to provide a relatively smaller mixer-conveyor to process the amount of material for which a larger prior mixer-conveyor would be required, or to increase the retention time within the mixer allowing a greater quantity of adherent substance to be added.

The improved mixer allows addition of amounts of water to wheat, for example, greater than 4.5% the water/wheat adhesion limit. The highly efficient mixing process of the mixer enables the addition. The ability to add more than the water/grain adhesion limit enables elimination of a step of grain tempering in some cases. In addition the capability of this greater addition has made possible new methods of equilibrating grain moistures to produce higher milling yields.

The screw conveyors of the prior art did not result in even distribution of the water on the grain. This was due to the lack of adequate interaction between the particles of conveyed grain. The improved mixer overcomes this problem by causing greater interaction between mixed particles.

In another embodiment of the invention, two paddle mixer-conveyors are placed in the same housing with provision for material interchange between the two mixers. The result is an increase in capacity which is greater than the capacity of two single mixer-conveyors. This is due to a greater interaction of particulate material and fluid due to the interaction of the two paddle mixer-conveyors.

These and other features, objects and advantages of the present invention will become apparent in the detailed description and claims to follow, taken in conjunction with the accompanying drawings in which like parts bear like reference numerals.

BRIEF DESCRIPTION OF THE DRAWINGS

FIG. 3 is a view of the shaft and paddles of the first embodiment.

FIG. 5 is a vertical section of the embodiment of FIG. 4.

DETAILED DESCRIPTION OF THE PREFERRED EMBODIMENT

Figures 1, 2:
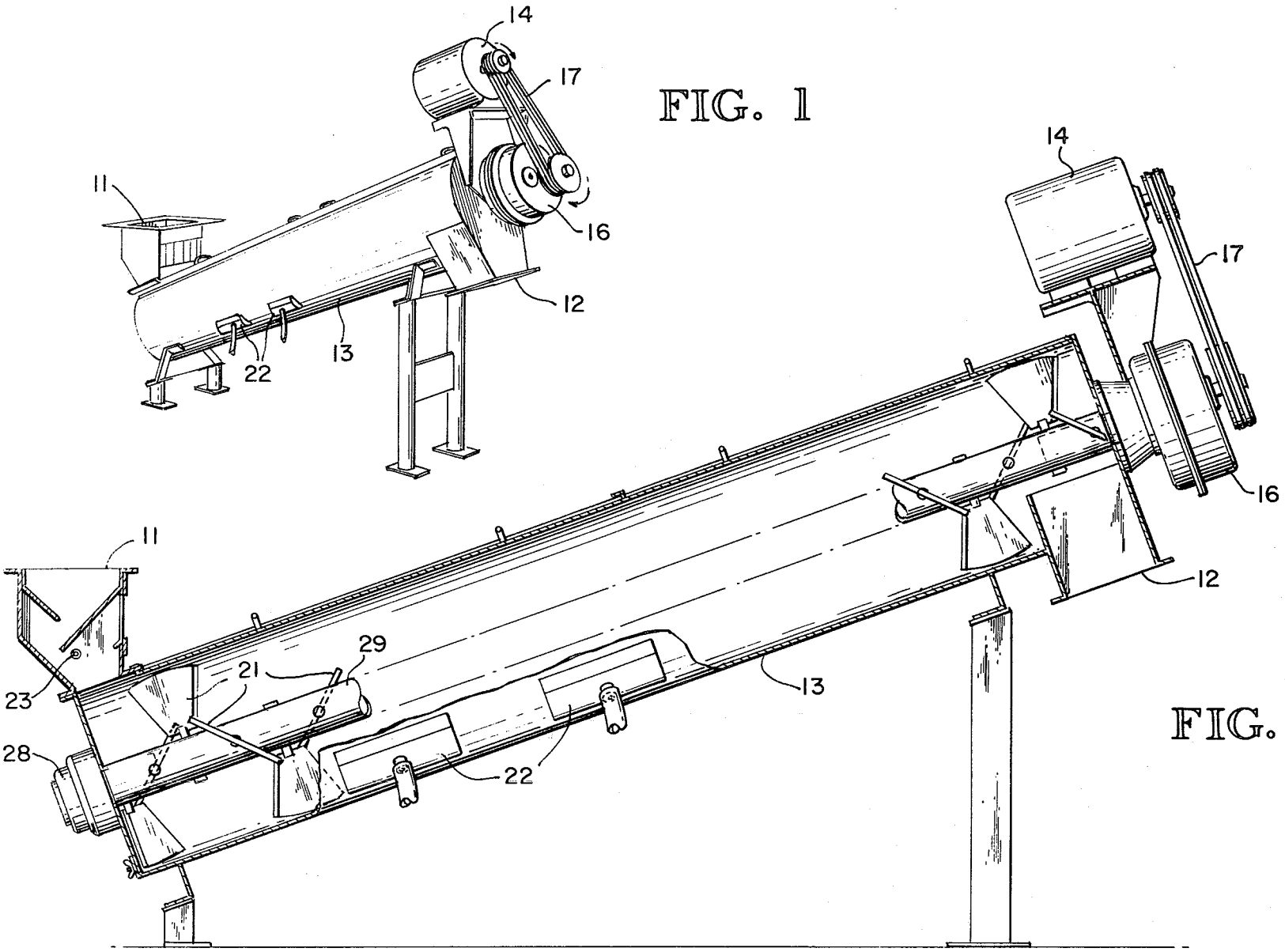
FIG. 1 is an oblique drawing of a paddle mixer-conveyor embodiment of this invention.
FIG. 2 is a sectional view of the embodiment of FIG. 1.

Referring to FIG. 1, the mixer-conveyor of this invention includes a housing 13, a means of the introduction of particulate material 11, an outlet 12 for the mixed particulate material, and a motor 14 connected to belt 17 and a reduction gear 16. It is apparent that housing 13 is set at an angle, which functions as a part of the mixer.

Referring to FIG. 2, a section view of the embodiment of FIG. 1, particulate material is introduced via inlet 11. While in inlet 11, the particulate material passes a series of baffles until it reaches a fluid dispensing tube 23. In the case of grain tempering, water is added to the flowing particulate material. Fluid dispensing tube 23 may also be used to introduce chlorine solutions in water when treating cereals. After fluid addition, the particulate material enters housing 13. Housing 13, contains a shaft 29 rotatably journalled in the housing and walls, as at 28. Shaft 29 is rotated by motor 14 through belts 17 and reduction gear 16. In this embodiment, paddles 21 are connected to shaft 29. The particulate material upon reaching the housing is alternately lifted and mixed by paddles 21 thereby progressing upward in housing 13. The arrangement and angles of paddle 21 is such that the particulate material is lifted many times before reaching outlet 12. Each time the particulate material is lifted, it flows off paddle 21 due to the force of gravity. The result is rapid and orderly interaction between the particles of solid material distributing and re-distributing fluid dispensed onto the particles by tube 23. In some embodiments, steam pads 22 are attached to the housing to elevate the temperature within housing 13. When liquid is added to absorbing-type particulate material, such as grain, any liquid redistribution among the particles must occur before the liquid penetrates into the particles.

The present invention distinguishes over applicant's prior paddle mixer in the utilization of the discovery that appropriate selection of the angularity of the paddles (herein "paddle settings") can permit substantially greater liquid additions than heretofore possible without liquid runoff and also can significantly increase the capacity of a paddle mixer of any specified dimensions.

With reference to Table 1, a machine of constant capacity is exemplified showing the throughputs obtained with differing paddle settings.

TABLE 1

| | Paddle Number | | | | | | | | | | | | | | | | | | | | | |
|---|---|---|---|---|---|---|---|---|---|---|---|---|---|---|---|---|---|---|---|---|---|---|
| EXAMPLE | 1 | 2 | 3 | 4 | 5 | 6 | 7 | 8 | 9 | 10 | 11 | 12 | 13 | 14 | 15 | 16 | 17 | 18 | 19 | 20 | 21 | 22 |
| A | 55 | 47 | 46 | 46 | 45 | 45 | 46 | 47 | 47 | 47 | 50 | 52 | 50 | 47 | 47 | 47 | 47 | 46 | 45 | 30 | −15 | 0 |
| B | 55 | 50 | 50 | 48 | 48 | 48 | 48 | 50 | 51 | 52 | 53 | 54 | 52 | 52 | 50 | 48 | 46 | 46 | 46 | 46 | 20 | 20 |
| C | 55 | 50 | 50 | 48 | 48 | 48 | 48 | 49 | 50 | 52 | 54 | 54 | 54 | 53 | 48 | 47 | 47 | 46 | 46 | 35 | 0 | 0 |
| D | 55 | 53 | 53 | 50 | 50 | 50 | 50 | 51 | 52 | 53 | 54 | 55 | 56 | 54 | 53 | 52 | 51 | 44 | 47 | 46 | 20 | 20 |
| | Paddle Angle | | | | | | | | | | | | | | | | | | | | | |

Example A shows the mixer paddle settings set to achieve a throughput of 333 bushels per hour and a retention time of 37.4 seconds.

Example B shows the same mixer with paddle settings for a throughput of 478.8 bushels per hour and a retention time of 25.9 seconds.

Example C shows the same mixer with paddle settings for a throughput of 665 bushels per hour and a retention time of 18.7 seconds.

Example D shows the same mixer with paddle settings for a throughput of 831.25 bushels per hour and a retention time of 15 seconds. It is apparent from the above examples that there is a linear relationship between the retention time and the throughput of the mixer of this invention of a given capacity. All of the above examples utilize what is best called a damming effect.

The damming effect is produced by raising the angle 33 of the paddles 29 in the middle portion of the machine to cause them to have a greater conveying action. This is combined with reduction of angle 33 of the paddles 21 in outlet end of the machine to produce slower flow and greater mixing action. This piles up admixed materials at the outlet end relative to an undammed machine. The particulate material that piles up at the outlet end of the machine produces a dam to counteract the natural tendency of the particulate material to seek its natural angle of repose. Thus, the capacity and retention time of the machine are increased. The increase in paddle angle setting near the center of the mixers has been found necessary to prevent "choking" at high throughputs. The high angle setting near the inlet is not necessary for all situations.

The above settings were determined by experimentation. A process for measuring capacity of the machine was devised by measuring the relative heights of grain in a stocked machine above shaft 29. A number of various paddle angle 33 combinations were tried at random until those producing the highest level of grains above the shaft without causing the grain to spill were determined. The above configurations were found during this experimentation and the explanation of a dam became apparent. The above settings are used in present machines of all sizes. In newly created machines, it is necessary to determine the proper paddle setting for a given retention time and throughput. In that case, approximate settings of the paddles to produce a damming effect are tried and the machine capacity tested. The paddles are then individually adjusted until the desired capacity is achieved. When the desired capacity of the machine is obtained, the paddles 21 are fixed at that position. Unless the conditions required are unusual, such as those requiring extremely long retention time, to allow greater addition of water the damming effect is used.

The level of material in a mixer with the above paddle setting is substantially parallel with shaft 29. By use of this improvement the rated throughput has been increased as shown in Table II below which compares applicant's prior paddle mixer-conveyor with the improved paddle mixer-conveyor of this invention.

TABLE II

| | | | | | | | |
|---|---|---|---|---|---|---|---|
| Old throughput in Bu/Hr. | 390 | 520 | 710 | 925 | 1130 | 1310 | 1540 |
| New throughput in Bu/Hr. | 430 | 665 | 950 | 1250 | 1770 | 2370 | 3010 |
| Pitch diameter (size of machine) | 12" | 14" | 16" | 18" | 20" | 22" | 24" |

As is readily apparent, the economics of scale are impressive. A smaller machine with corresponding lower cost of materials and manufacture is thus able to do the work of a larger machine. Alternately, the program allows the machine to be set for longer retention times than were previously obtainable. The longer retention time can eliminate one step of tempering in some cases.

Figure 4:
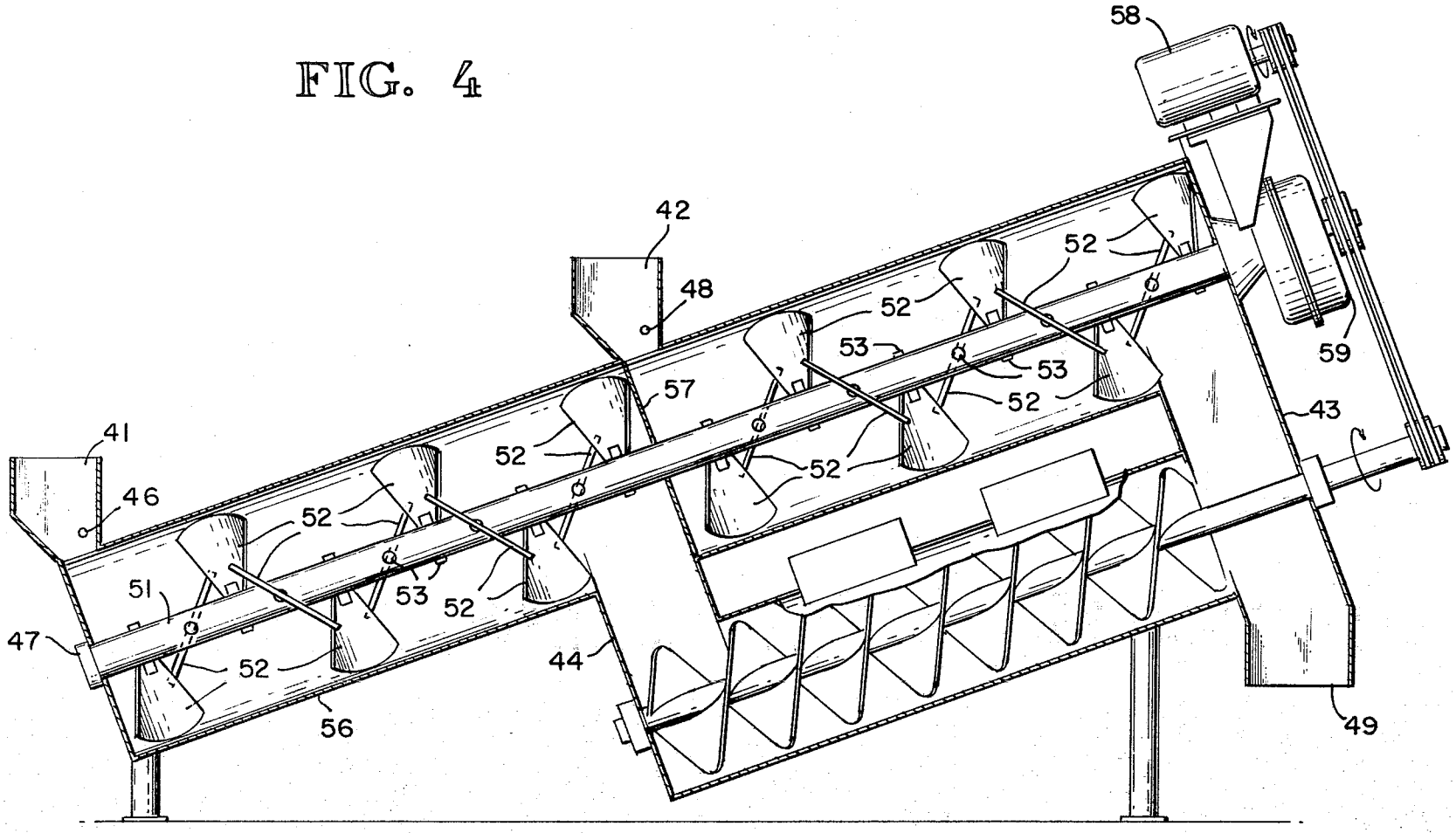
FIG. 4 is a section view of another paddle mixer-conveyor embodiment of this invention.

Referring now in particular to FIG. 4, the configuration of a second embodiment of the invention is shown. In this embodiment there are two inlets 41, 42 for the introduction of particulate solid material. Each inlet has associated with it a spray bar 46, 48 for the introduction of a fluid material. Additionally in this embodiment, there are two outlets 44, 43 for the removal of admixed solid particulate material. A motor 58 turns shaft 51 by means of a reduction gear 59. Shaft 51 has a plurality of paddles 52 attached. In this embodiment, each shaft has 24 paddles attached. The end of shaft 51 away from motor 58 is supported by bearing 47 herein. It will be noted that housing 66 is divided into two compartments by a partition 57. Thus, there are two compartments each having an inlet 41, 42, outlet 44, 43, and a spray bar 46, 48. Each compartment has 12 paddles turning on the shaft in that compartment.

Referring now to FIG. 5 which is a sectional drawing of FIG. 4's embodiment. In this embodiment, it will be seen that each of the compartments of FIG. 4 contains two shafts turning within it. It will be apparent that shaft 51 rotates in a counter-clock-wise direction 62, and shaft 61 rotates in a clock-wise direction. Thus, in each compartment there are two counter-rotating shafts each having 11 paddles. FIG. 5 also makes clear the relationship between spray bar 46 and inlet 41.

The mixer may also be constructed without partition 57. In this configuration there is only one inlet 41 and one outlet 44.

It is apparent that housing 56 does not isolate the streams of material carried by shafts 51 and 61. Material carried by shaft 51 is allowed to interact with material carried by shaft 61 and vice versa. It has been found that this configuration results in increased mixing efficiency and greater machine capacity. In addition, the wider housing 56 allows the use of greater tip speed without causing grain to overflow.

A machine with two shafts 51, 61 each shaft having paddles with a 20" pitch diameter has been found capable of processing 5000 bushels per hour. A single shaft mixer of the same pitch diameter operating at the same temperature and moisture addition can process 1770 bushels per hour. It is therefore apparent that the throughput is more than doubled by using the two shaft design.

A machine having two shafts 51, 61, two inputs 41, 42, two outputs 43, 44 and partition 57 as described above, is capable of processing 10,500 bushels per hour. A single shaft design of similar pitch diameter processes 3010 bushels per hour at the same temperature and percentage of water addition. The synergistic effect is even more pronounced in this case.

Returning once more to FIG. 4, the outlets 44, 43 can be combined together into a common outlet 49 if desired by the miller.

The damming feature previously defined for the single shafted machine may also be used with the double shafted machine. The following angle settings were tested and found successful with a double shafted machine: each of the four sections of 12 paddles was adjusted as follows: #(1) 55 degrees, #(2) 40 degrees, #(3) 40 degrees, #(4) 46 degrees, #(5) 48 degrees, #(6) 48 degrees, #(7) 46 degrees, #(8) 45 degrees, #(9) 43 degrees, #(10) 40 degrees, #(11) 30 degrees, #(12) 0 degrees. These settings resulted in increasing machine throughput to 5000 bushels per hour at a constant retention time of 18.7 seconds.

It will be noted that the highest blade angle was on blade 1 and the lowest on blade 12. As was stated earlier in the single screw machine, blades are numbered from the end nearest the inlet.

It has been found that machines utilizing the damming effect are also capable of reducing the range of moisture contents in individual grains. A testing procedure to select 100 grains of wheat at random from a sample and measuring the percent of moisture of each grain was devised. The range is defined as +or −three standard deviations (i.e. $\pm 3\ \theta_s$). Using this procedure and a convention screw conveyor wetting method the following results were obtained: In a sample of 100 grains having an initial moisture range of from 9 to 13 percent moisture and a mean moisture of 11.28% with a range of 4.12% and a standard deviation of 0.686 as load, a screw conveyor operating at 425 bushels per hour made the addition of 2.24% moisture. The moistened grain was tested by the same procedure. A range of from 11 to 24% moisture was found. Thus, the mean moisture was increased to 15.52% with a range of 8.46% and a standard deviation of 1.41%. As is apparent, both the percentage of moisture and the range of grain moisture content was increased by the screw conveyor wetting method. A large range of moisture is undesirable in milling as it decreases the percentage of profitable products and increases the waste in milling. The increase in range in the screw conveyor is due to the lack of effective interaction between individual grains in the conveyor as compared to the effective interaction in the mixers of this invention.

The above procedure was then conducted with a mixer using the principle of damming. A 9" pitch diameter paddle mixer-conveyor of the present invention, operating at throughput of 200 bushels per hour was used. A load of wheat having an initial range of moisture from 6.5 to 11% and thus a range of 5.71% was loaded. In the initial load of wheat the average moisture was 9.36% with a standard deviation of 0.952, 2.8% of moisture was added in the paddle mixer wetting process. The output was tested by the above method and found to have an average moisture content of 12.23%. The range was found to be 4.94% and the standard deviation at 0.823. The mixer thus decreased both the range and standard deviation of moisture content from that in the initial load.

Further tests on different size mixers confirmed the results of the above test.

The throughput capabilities and ability to add more than the water/grain adhesion limit (e.g. 4.5% for water/wheat allow new methods of grain processing:

Grain as received from shippers has varying moisture contents dependent upon the type of grain and the conditions under which it was grown. Moisture contents can be as low as 5% for wheat grown in the desert climates to as high as 15% or more for temperate regions. This wide variation in wheat moisture content causes a decrease in the percent of flour "obtained from the milling." Procedures that reduce moisture variations between kernels can increase the amount of profitable product. The percentage shown is the range of water contents. FIG. 7 discloses the probability profiles of different grain samples used in a milling test experiment. The above samples were milled and the amount of products analyzed. The results obtained are shown in FIG. 8.

It is apparent that the greater the range of moisture content the lower the output of desired product.

To ensure less range of kernal moisture content the following process has been devised.

Figure 6:
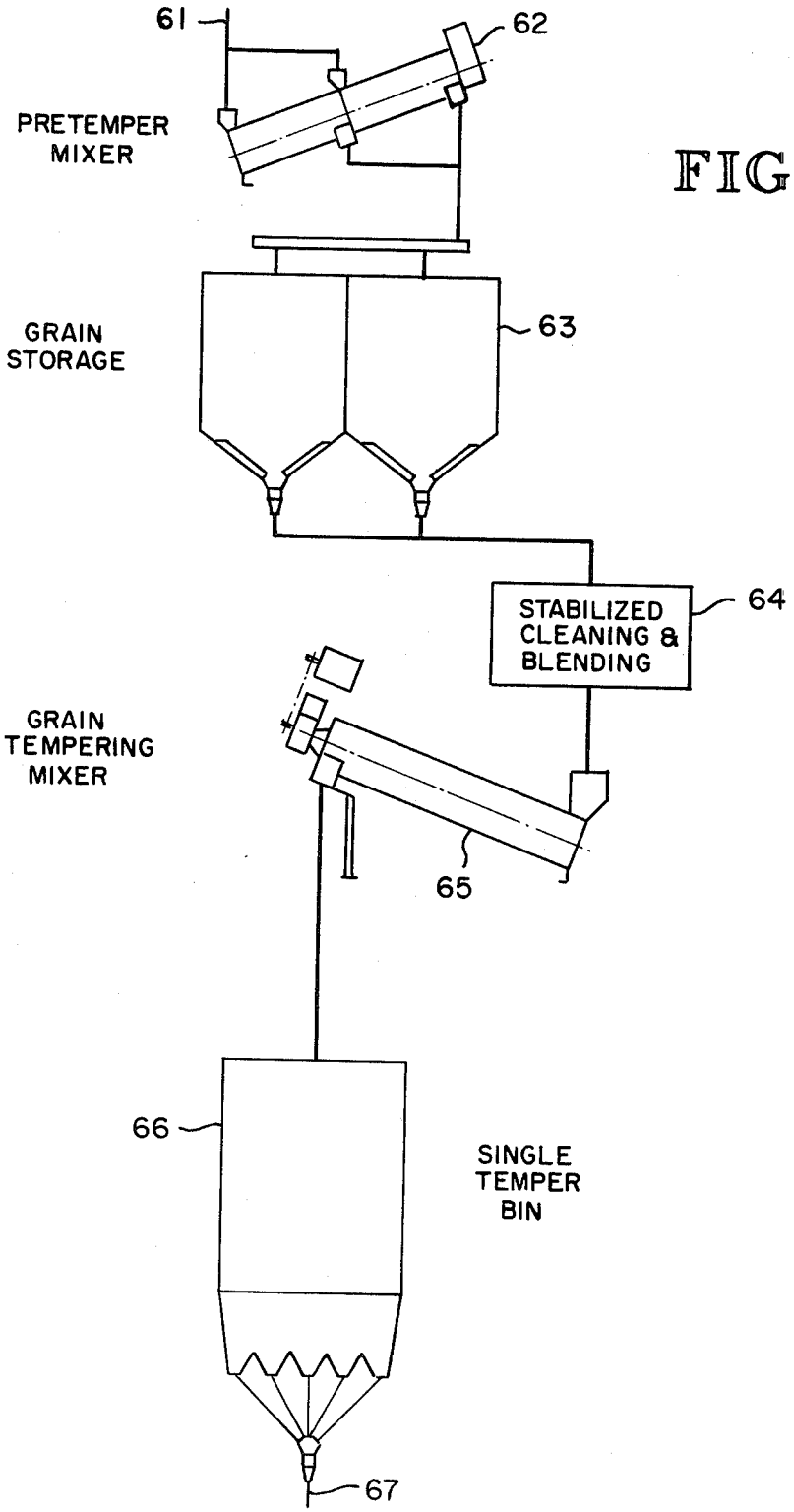
FIG. 6 is a flow or process diagram illustrating grain processing in accordance with the present invention.

FIG. 6 shows a schematic representation of the process. Grain lots having a mixture of moistures enter the mill and its each lots moisture content is measured 61. In prior processes the grain was stored then milled. The grain as it arrives has four types of variations of moisture. First there is the variation caused by the variation between different shipments of grain from different sources. This variation is caused by the environment in which the grain is grown and the nature of the strains of grain. A second variation is caused by lot to lot discrepancies within individual shipments. This can be caused by variations between carloads in a shipment. The third variation is introduced by conventional wetting screw grain tempering processes. Finally, there is the variation between individual particles of grain in each lot. In a conventional processing system the total range would thus be the difference between the driest particle of grain of the driest lot and the wettest particle of grain of the wettest lot. This is due to the conventional system' binning of grains together. This invention reduces all four types of moisture variations.

An arbitrary average storage moisture content is selected. The usual amount for wheat is about 12–13%. Grain having moisture content below this amount is wetted in a high capacity mixer 62. The wetting of the grain reduces the moisture variation between lots as all are wetted to the same average valve. The variation between individual particles is also reduced by virtue of mixer operation as previously described. Grain that is wetter than the average selected may be dried by conventional methods.

The grain is now conveyed to a storage system 63. Here the grain is stored for at least the period of time required for the added water to be absorbed by the grain. These steps have now minimized the shipment to shipment and lot to lot variation without the introduction of new variations.

The grain is now cleaned and blended as in prior milling processes.

The grain is wetted in a grain tempering mixer 65 prepatory to milling. The moisture content is raised to that desired for most economical milling. The wetting process is preferably conducted in the disclosed type of mixer to prevent the introduction of new moisture variations. This step eliminates the introduction of variations by the wetting screw and reduces kernal to kernal variations.

The wetted grain is now binned 66 to allow for the absorption of added moisture. This storage time is typically 12–24 hours. The uniformly wetted grain is then milled by conventional milling processors.

As a result of the above process preventing disparity of particle moisture, a substantial savings to the miller results. On one test of the above process using wheat as the grain a reduction in the range of moisture 7.54% to 6.14% resulted. The change in the range of moisture content before milling resulted in a savings to the miller of 7.76 cents per hundred weight of flour produced as compared to conventional milling processes.

In addition to wheat the mixers illustrated have been used with corn, oats, and rye. Other grains could also be processed by similar methods. The reaction time varies for differing grain, and differing moisture additions, and paddle angles must be adjusted accodingly.

It has been found possible to control the addition of moisture in mixes by controlling temperature. FIG. 9 shows the moisture increase versus the size factor. The size factor is the central actual throughput divided by the rated throughput. The throughput is rated for a throughput at 4.2% moisture addition and 18.7 seconds retention time at 50° F.

It is apparent that more moisture can be added at greater temperatures. The temperature is controlled in the mixer by use of steam pads 22.

Although several preferred embodiments of the invention have been illustrated and described herein, variations will become apparent to one of ordinary skill in the art. Accordingly, the invention is not to be limited to specific embodiments illustrated and described herein, and the true scope and spirit of the invention are to be determined by reference to the appended claims.

The embodiments of the invention in which exclusive property or privilege is claimed are defined as follows:

1. A particulate material mixer-conveyor comprising:

elongated housing means for receiving a bed of particulate material, said housing means having a particulate material inlet at one end and a particulate material outlet at the other end;

means operatively associated with said housing means for introducing a second material into said housing for distribution onto a particulate material conveyed in said housing;

a shaft rotatably mounted in said housing means and extending lengthwise therethrough;

a plurality of paddles extending outward from said shaft for lifting said particulate material out of said bed, the paddles in proximity to the inlet being mounted at the highest angle relative to the shaft those in proximity to the outlet being mounted at the lowest angle and the remaining paddles being mounted at intermediate angles which gradually increase to a peak in the mid portion of the shaft; and means for rotating the shaft at a speed such that said particulate material flows off the paddle as it is lifted.

2. A particulate material mixer-conveyor as in claim 1 wherein the mixer-conveyor includes a plurality of shafts rotatably mounted in said housing and a plurality of paddles attached to each of said shafts for conveying and mixing said particulate material.

3. A solid particulate material mixer-conveyor is in claim 2 wherein said plurality of shafts comprises two counter-rotating shafts.

4. A solid particulate material mixer-conveyor as in claim 3 wherein said housing is divided by a partition perpendicular to said shafts into two compartments, each of said compartments having particulate material inlets and outlets and each of said compartments having introduction means.

5. A solid particulate material mixer-conveyor as in claim 4 wherein the paddles are attached to said shafts at a paddle angle which is adjustable for varying the mixing and conveying of said particulate matter.

6. A solid particulate material mixer-conveyor as in claim 2, further comprising temperature control means.

7. An apparatus for mixing a particulate material with a fluid comprising:

means forming a housing for receiving a bed of particulate material, said housing having an inlet and an outlet for said particulate material;

means for adding a fluid material to a particulate material;

shaft means rotatably mounted in said housing and extending from a location adjacent said inlet to a position adjacent said outlet;

a plurality of paddles mounted on said shaft means and extending outward therefrom for lifting the material out of said bed and conveying it towards said outlet, said plurality of paddles including a first paddle mounted adjacent said inlet, a second paddle mounted adjacent said outlet and at least two center paddles mounted between said first and second paddles, the pitch angle of said second paddle being less than that of the center paddles and the pitch angle of the center paddles increasing with increasing distance from said first paddle; and means for rotating said shaft means such that said particulate material flows off the paddles as it is lifted thereby, whereby said fluid is mixed with said particulate material to distribute it uniformly thereon.

8. The apparatus of claim 7 wherein the pitch angle of said first paddle is greater than the pitch angle of said central paddles.

9. The apparatus of claim 7 wherein said shaft means comprises two shafts rotatably mounted in said housing each shaft having a plurality of paddles mounted thereon and wherein said drive means rotates said shafts in opposite directions.

10. The apparatus of claim 7 further comprising a second housing means having an inlet and an outlet for receiving a bed of particulate material and wherein said shaft means further extends between the inlet and outlet of said second housing means.

11. The apparatus of claim 7 further comprising means for controlling the temperature of said particulate material.

12. The apparatus of claim 7 wherein said housing means is inclined at an angle and wherein said shaft means is rotated to convey said particulate material upward through said housing means.

13. The apparatus of claim 7 wherein said shaft means includes fist and second shafts rotatably mounted in said housing and said means for rotating said shaft means rotates said first and second shafts in opposite directions.

* * * * *